US006895374B1

(12) United States Patent
Pai

(10) Patent No.: US 6,895,374 B1
(45) Date of Patent: May 17, 2005

(54) METHOD FOR UTILIZING TEMPORAL MASKING IN DIGITAL AUDIO CODING

(75) Inventor: Wan-Chieh Pai, Fremont, CA (US)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 889 days.

(21) Appl. No.: 09/675,541

(22) Filed: Sep. 29, 2000

(51) Int. Cl.[7] ..... G10L 19/00

(52) U.S. Cl. ..... 704/200.1; 704/231; 704/243; 704/229

(58) Field of Search ..... 704/200.1, 231, 704/243, 229

(56) References Cited

U.S. PATENT DOCUMENTS 4,972,484 A * 11/1990 Theile et al. ..... 704/200.1
5,450,522 A * 9/1995 Hermansky et al. ..... 704/200.1
5,459,815 A * 10/1995 Aikawa et al. ..... 704/254
5,491,481 A * 2/1996 Akagiri ..... 341/87
5,752,225 A * 5/1998 Fielder ..... 704/229
5,848,384 A * 12/1998 Hollier et al. ..... 704/231
6,119,083 A * 9/2000 Hollier et al. ..... 704/243
6,271,771 B1 * 8/2001 Seitzer et al. ..... 341/50
6,301,555 B2 * 10/2001 Hinderks ..... 704/200.1

* cited by examiner

*Primary Examiner*—Richemond Dorvil
*Assistant Examiner*—Qi Han
(74) *Attorney, Agent, or Firm*—Thomas F. Lebens; Fitch, Even, Tabin & Flannery

(57) ABSTRACT

A method incorporating the use of a filter that accepts simultaneous masking signals and generates a close replica of temporal masking signals derived from the input simultaneous masking signals. The filter output is then added to the filter input to provide a composite masking signal. This composite masking signal may then be used to establish overall masking threshold levels which can be mapped in the appropriate subband to significantly reduce the amount of coding quantization required without significantly affecting the perceived sound of the reconstructed broadband signal.

The filter's transfer function and impulse response define a filter the output of which exhibits two principal characteristics of temporal masking. One such characteristic is decay with the logarithm of time. The other is a rate of decay that is inversely proportional to the duration of the corresponding simultaneous masking.

19 Claims, 6 Drawing Sheets

METHOD FOR UTILIZING TEMPORAL MASKING IN DIGITAL AUDIO CODING

BACKGROUND OF THE INVENTION

1. Field of the Invention

The present invention relates generally to the field of digital audio and more specifically, to the field of perceptual coding of digital audio.

2. Background

Perceptual coders analyze the frequency and amplitude content of an input signal and compare it to a model of human auditory perception. Using the model, the encoder removes the irrelevancy of the audio signal. In theory, although the method is lossy, the human perceiver will not hear degradation in the decoded signal. Considerable data reduction is possible. A well-designed perceptually coded recording, with a conservative level of reduction, can rival the sound quality of a conventional recording because the data is coded in a much more intelligent fashion, and because the listener doesn't hear all of what is recorded to begin with. In other words, perceptual coders require only a fraction of the data needed by a conventional system.

Data reduction coders attempt to represent the audio signal at a reduced bit rate while minimizing quantization error. Time-domain coding methods such as delta modulation can be considered to be data-reduction coders. They use prediction methods on samples representing the full bandwidth of the audio signal and yield a quantization error spectrum that spans the audio band. Frequency-domain encoders take a different approach. The signal is analyzed in the frequency domain and coded so that quantization error can be assigned and masked based on psychoacoustic characteristics of the ear. However, coder complexity is greatly increased.

Most low-bit-rate codecs use psychoacoustic models to adaptively quantize only the perceptually significant parts of the signal. Parts of the signal that are below the minimum threhold, or masked by more significant signals, are judged to be inaudible and are not coded.

Amplitude masking occurs when a tone shifts the threshold curve upward in a frequency region surrounding the tone. The masking threshold describes the level where a tone is barely audible. When tones are sounded simultaneously, masking occurs in which louder tones can completely obscure softer tones. For example, a tone of 500 Hz can mask a concurrent softer tone of 600 Hz. The strong sound is called the masker and the softer sound is called the maskee. Masking theory argues that the softer tone is just detectable when its energy equals the energy of the part of the louder masking signal in the critical band; this is a linear relationship with respect to amplitude. Generally, depending on relative amplitude, soft (but otherwise audible) audio tones are masked by louder tones at a similar frequency (within 100 Hz at low frequencies).

Temporal masking occurs when tones are sounded close in time, but not simultaneously. A signal can be masked by a noise or another signal that occurs later. This premasking is sometimes called backward masking. In addition, a signal can be masked by a noise or another signal that ends before the signal begins. This is post masking, sometimes called forward masking. In other words, a louder tone appearing just before (pre-masking), or after (post masking) a softer tone overcomes the softer tone. Just as simultaneous masking increases as frequency differences are reduced, temporal masking increases as time differences are reduced.

Temporal masking decreases as the duration of the masker decreases. In addition, a tone is post masked by an earlier tone when they are close in frequency or when the earlier tone is lower in frequency. Post masking is slight when the masker has a higher frequency. Logically, simultaneous masking is stronger than either pre- or post masking because the sounds occur at the same time.

Temporal masking is important in frequency domain coding. These coders have limited time resolution because they operate on blocks of samples, thus spreading error over time. Temporal masking can overcome audibility of artifacts caused by transient signals. Ideally, filter banks should provide a time resolution of 2 to 4 ms. Acting together, amplitude and temporal masking form a contour that can be mapped in the time-frequency domain.

In subband coding, blocks of consecutive time-domain samples representing the broadband signal are collected over a short period and applied to a digital filter bank. The filter bank divides the signal into multiple bandlimited channels to approximate the critical band response of the human ear.

Each subband is coded independently with greater or fewer bits allocated to the samples in the subband. In any case, quantization noise is increased in each subband. However, when the signal is reconstructed, the quantization noise in a subband will be limited to that subband, where it is masked by the audio signal in each subband. Bit allocation is determined by a psychoacoustic model and analysis of the signal itself. These operations are recalculated for every subband in every new block of data. Samples are dynamically quantized according to audibility of signals, and noise. There is great flexibility in the psychoacoustic models and bit allocation algorithms used in coders that are otherwise compatible. The decoder uses the quantized data to re-form the samples in each block. An inverse synthesis filter bank sums the subband signals to reconstruct the output broadband signal.

A subband perceptual coder uses a digital filter bank to split a short duration of the audio signal into multiple bands. In some designs, a side-chain processor applies the signal to a transform such as an FFT to analyze the energy in each subband. These values are applied to a psychoacoustic model to determine the combined masking curve that applies to the signals in that block. This permits more optimal coding of the time-domain samples. Specifically, the encoder analyzes the energy in each subband to determine which subbands contain audible information. A calculation is made to determine the average power level of each subband over the block. This average level is used to calculate the masking level due to masking of signals in each subband, as well as masking from signals in adjacent subbands. Finally, minimum hearing threshold values are applied to each subband to derive its final masking level. Peak power levels present in each subband are calculated and compared to the masking level. Subbands that do not contain audible information are not coded and in some cases entire subbands can mask nearby subbands which thus need not be coded.

SUMMARY OF THE INVENTION

The present invention comprises a method incorporating the use of a filter which accepts simultaneous masking signals and generates a close replica of temporal masking signals derived from the input simultaneous masking signals. The filter output is then added to the filter input to provide a composite masking signal. This composite masking signal may then be used to establish overall masking threshold levels which can be mapped in the appropriate subband to significantly reduce the amount of coding quantization required without significantly affecting the perceived sound of the reconstructed broadband signal.

In a preferred embodiment of the present invention, storage and computation usage are reduced by: (1) Employing such filtering for only about the lower two-thirds of the subbands; (2) using a second order auto-regressive and a second order moving average filter characteristic. The transfer function of the resulting filter may then be represented as:

$$H(z) = \frac{0.256z^{-1} + 0.059z^{-2}}{1 - 0.39z^{-1} - 0.295z^{-2}}$$

And its impulse response as:

$$H(n)=0.2224\ (0.7721)^n\mu(n)+0.0336\ (-0.3821)^n\mu(n)$$

The filter's transfer function and impulse response define a filter the output of which exhibits two principal characteristics of temporal masking. One such characteristic is decay with the logarithm of time. The other is a rate of decay that is inversely proportional to the duration of the corresponding simultaneous masking.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

Figure 1:
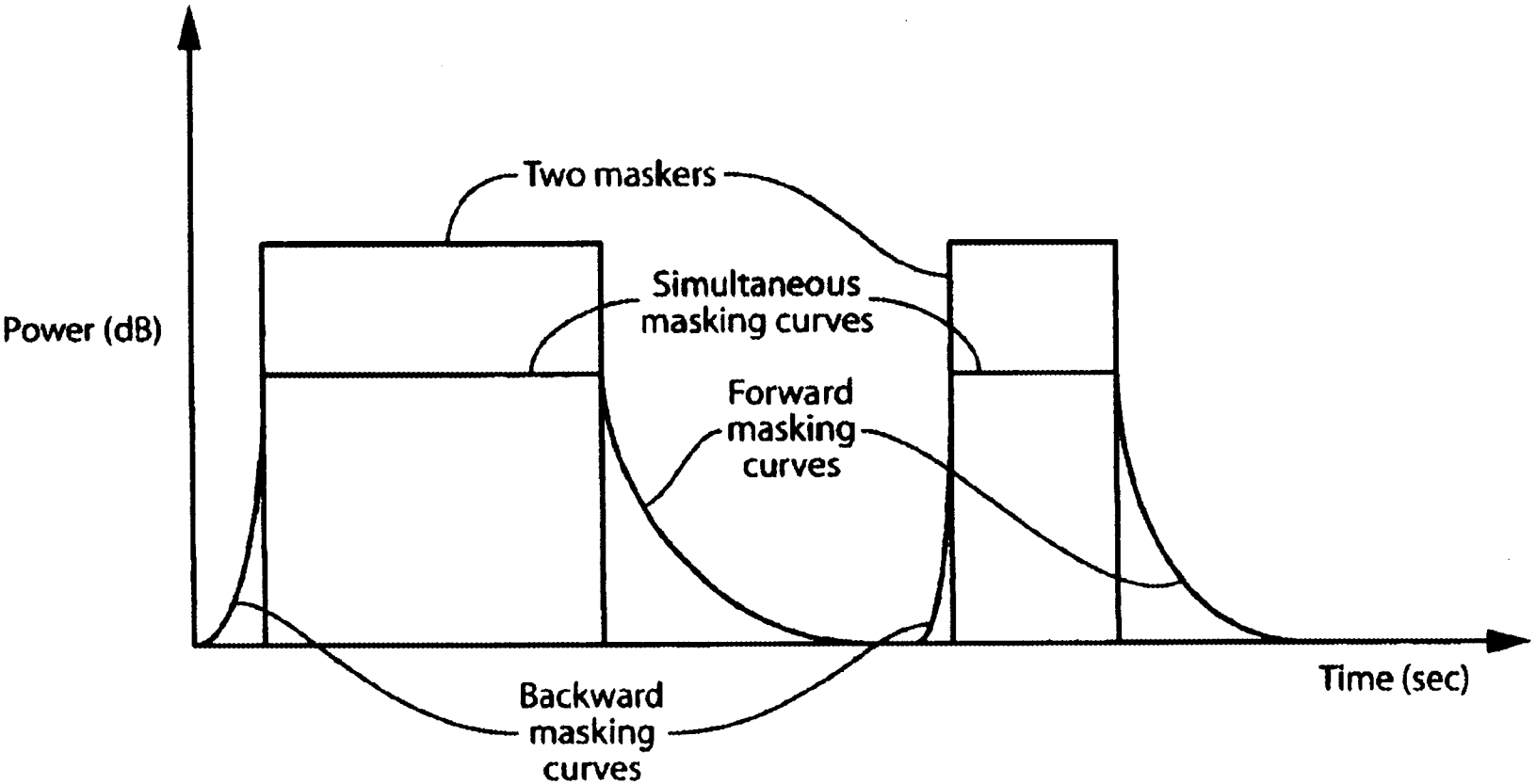
FIG. 1 is a graphical illustration of simultaneous and temporal masking.

While the invention is susceptible to various modifications and alternative forms, specific embodiments thereof have been shown by way of example in the drawings and will herein be described in detail. It should be understood, however, that the detailed description is not intended to limit the invention to the particular forms disclosed. On the contrary, the intention is to cover all modifications, equivalents, and alternatives falling within the spirit and scope of the invention as defined by the appended claims.

DETAILED DESCRIPTION OF A PREFERRED EMBODIMENT

FIG. 1 shows the basic principles indicating how masking thresholds are formed where simultaneous and temporal masking are caused by two different maskers. As shown in FIG. 1, forward masking thresholds decay with time from the simultaneous masking threshold caused by the same masker. In addition, the longer the masker lasts, the slower its forward masking threshold decays. As soon as the masker signal ends, the temporal masking thresholds starts out with the same magnitude of simultaneous masking threshold, and decays with time. Temporal masking effect not only exists in the frequency bands with the same frequency components, but it also affects all of the bands affected by simultaneous masking.

Figure 2:
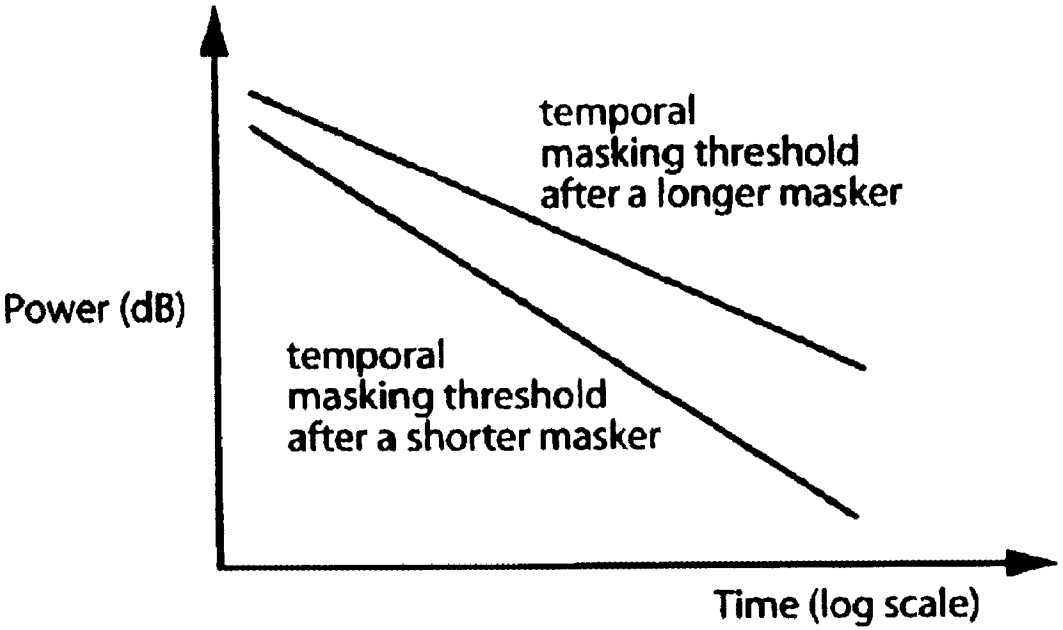
FIG. 2 is a graphical illustration of temporal masking decay showing its linearity with time in log.

Several factors affect the amount of forward masking: (1) Time difference from the ending edge of masker; masking decays exponentially in log time; (2) duration of masker; the longer the masker is, the slower the masking decays; (3) frequency relative to the masker; the way that masking decays is different for on-frequency, higher frequency and lower frequency bands; (4) absolute frequency of the masker masking is more effective in medium frequency bands (around 1000 Hz) than in high and low frequency bands; (5) power of masker; masking caused by a stronger masker decays faster; and (6) structure of the spectrum; decay of masking is faster if the masker is accompanied by other flanking signals in its neighboring bands. FIG. 2 illustrates the first two principles. In order to reduce computation for temporal masking, only these two factors are utilized.

The temporal masking mechanism of the present invention is embodied on a MPEG layer-2 encoding software which adopts psychoacoustical model one to determine simultaneous masking. This model breaks the whole spectrum into 127 bark-scaled subbands and computes a masking threshold for each subband. In the computation of the thresholds, the spectrum is simplified, thus no detail information can be derived directly from the spectrum. As a result, the calculated simultaneous masking threshold is the only thing that can be used as input information into the filter to compute forward masking.

There are several issues to consider in designing this filter. First, the temporal masking can last for more than 180 msec. That is longer than 7 frames when a 48 k sampling frequency is used. In order to account for the influence for such a long duration, a finite impulse response (FIR) filter needs to have the simultaneous masking thresholds for at least 7 previous frames. That is, 7[audio frames]×127[sub-bands]×2[channels]=1778 extra double variables needed To reduce the storage need, an infinite impulse response (IIR) filter is used. Second, the ordinary IIR filters (if they are stable) have the following form of outputs $$y(n) = \sum_{i=1}^{M} a_i(z_i)^i,$$

where m is the order of the IIR filter, and zi, i=1, . . . ,m, are poles of the IIR filter, and Zi have absolute values smaller than 1.

Figure 3:
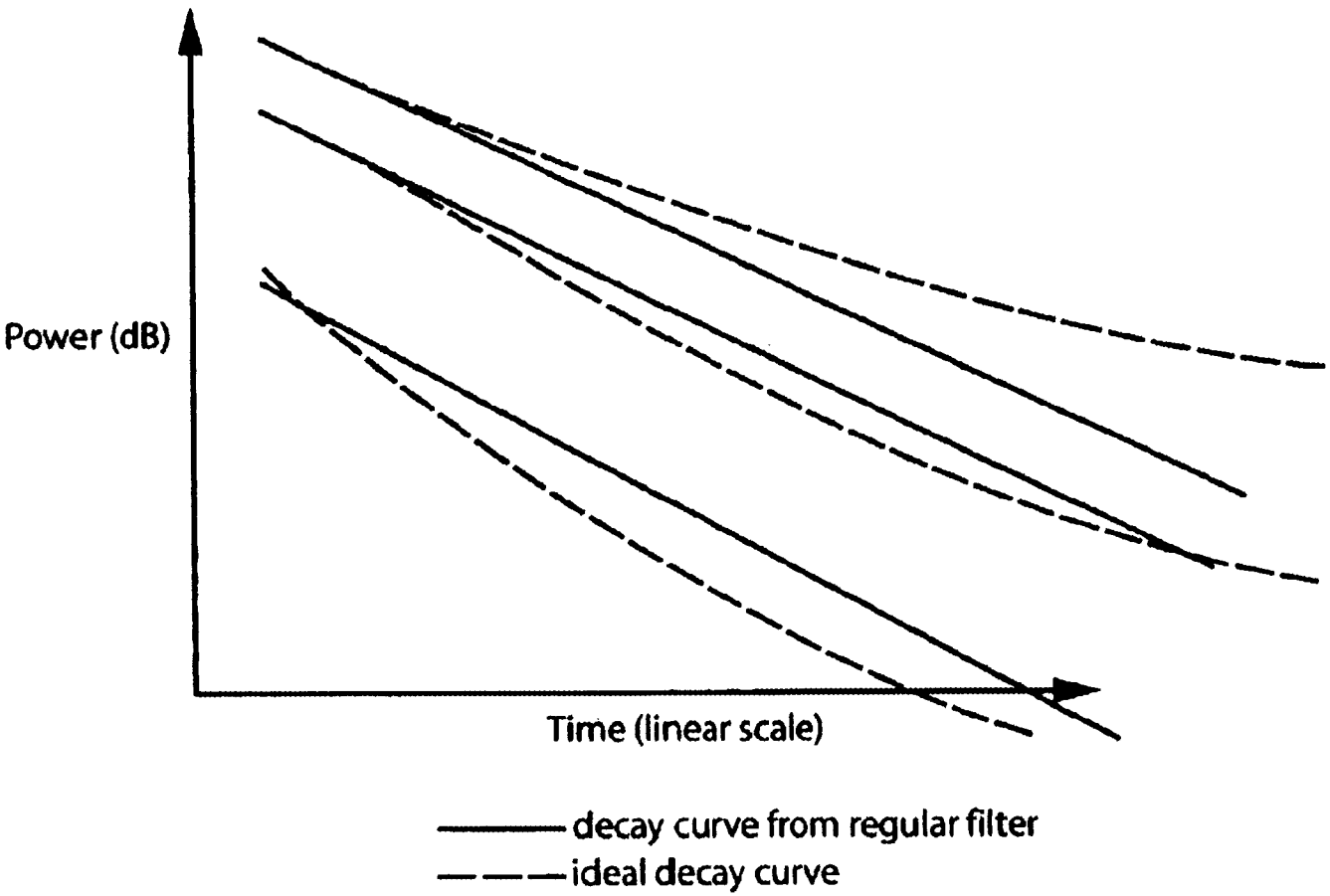
FIG. 3 is a graphical comparison of decay in an ideal filter and in a regular IIR filter.

According to the above equation, the output, y(n), decays exponentially with linear time, not with the logarithm of time as temporal masking thresholds act. To correct this discrepancy, the decay is pushed closer to decaying with the logarithm of time. FIG. 3 illustrates this problem: The three solid lines, from top to bottom, are the output signals from a regular IIR filter when the inputs are three, two, and one consecutive pulses. The three dashed lines are the corresponding desired outputs from an ideal filter. There are two major differences between the two sets of curves: One is that a linear decay rate is desirable with the logarithm of time, not with time itself; the other is that the decay rate for the output with shorter input is faster than the output with a longer input.

This problem is solved by the invention by making the output behave approximately ideally for at least the first several time frames after the temporal masker. After the first several frames, the temporal masking thresholds become less significant and are usually exceeded by simultaneous masking. Without any limitation on memory usage, the higher the filter order, the closer the realized decay curve can come to the ideal one. In terms of storage space, if the IIR filter equation is:

$$y(n) = \sum_{i=1}^{M} a_i x(n-i) + \sum_{j=1}^{L} b_i y(n-j)$$

and filtering is done for the lower 80 subbands (instead of 127), then the extra storage space needed is:

$$(M+L-1)\times 80\times 2=160(M+L-1)$$

Figure 4:
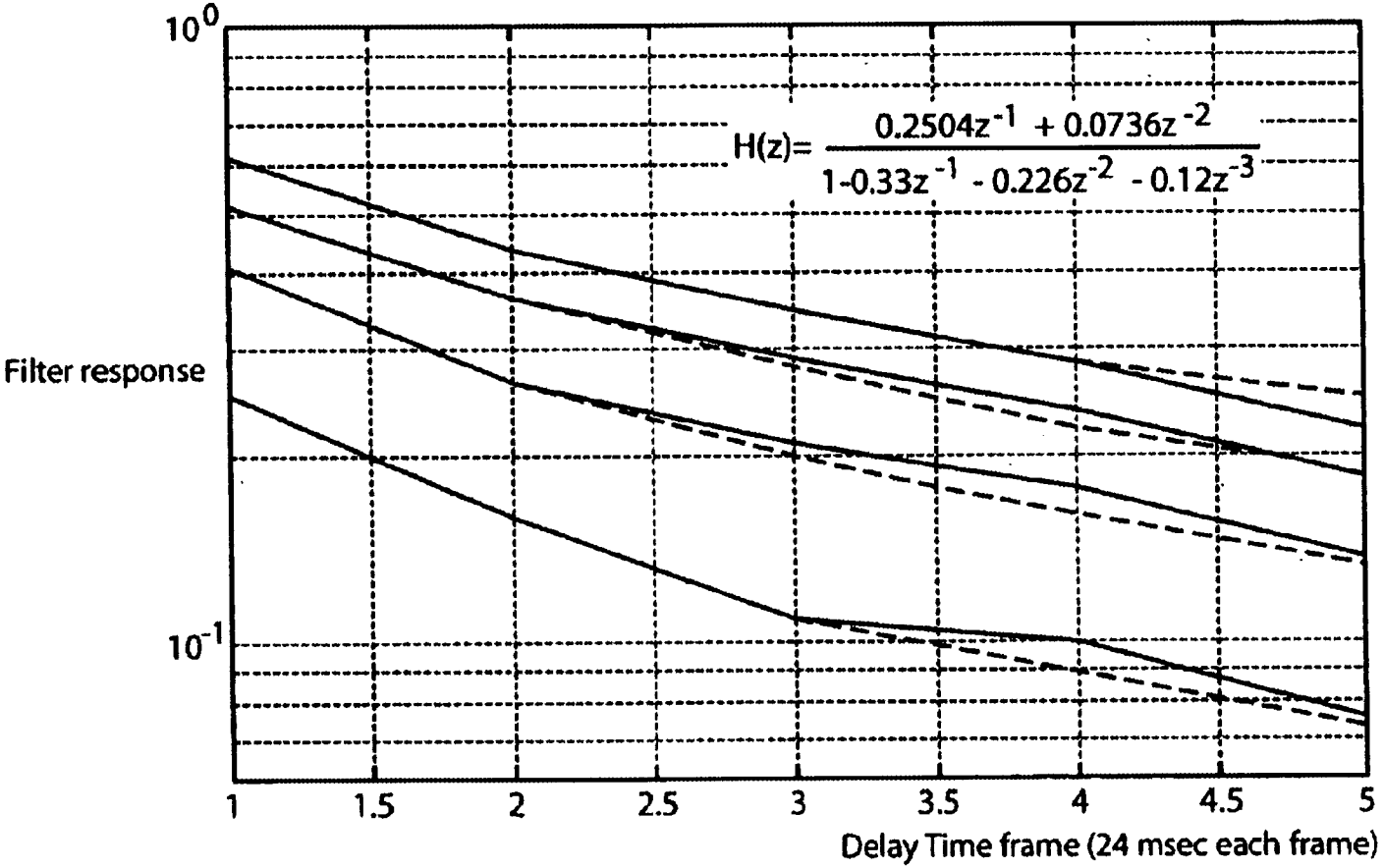
FIG. 4 is a graphical comparison of performance between an ideal filter and 3-2 ordered ARMA IIR filter.

If a third order AR (auto-regressive) is attempted with a second order MA (moving average) filter, then 640 extra variables are needed, and after careful selection of filter coefficients, the following equation and the decay behavior in FIG. 4 are obtained:

$$H(z) = \frac{0.2504z^{-1} + 0.0736z^{-2}}{1 - 0.39z^{-1} - 0.295z^{-2}}$$

According to FIG. 4, within 5 time frames from the masker, the temporal masking behavior is approximated by the 3-2 ordered ARMA filter. After 5 time frames, the 3-2 ARMA filter usually under-estimates the temporal masking effect, although these are tolerable. If one wants to further reduce storage and computation usage in the process, one can simplify the above 3-2 ordered filter to a 2-2 ordered ARMA filter which uses 480 extra double variables. The transfer function with optimal parameters is:

$$H(z) = \frac{0.256z^{-1} + 0.059z^{-2}}{1 - 0.39z^{-1} - 0.295z^{-2}}$$

And its impulse response is:

$$h(n)=0.2224(0.7721)^n u(n)+0.0336(-0.3821)^n u(n)$$

Figure 5:
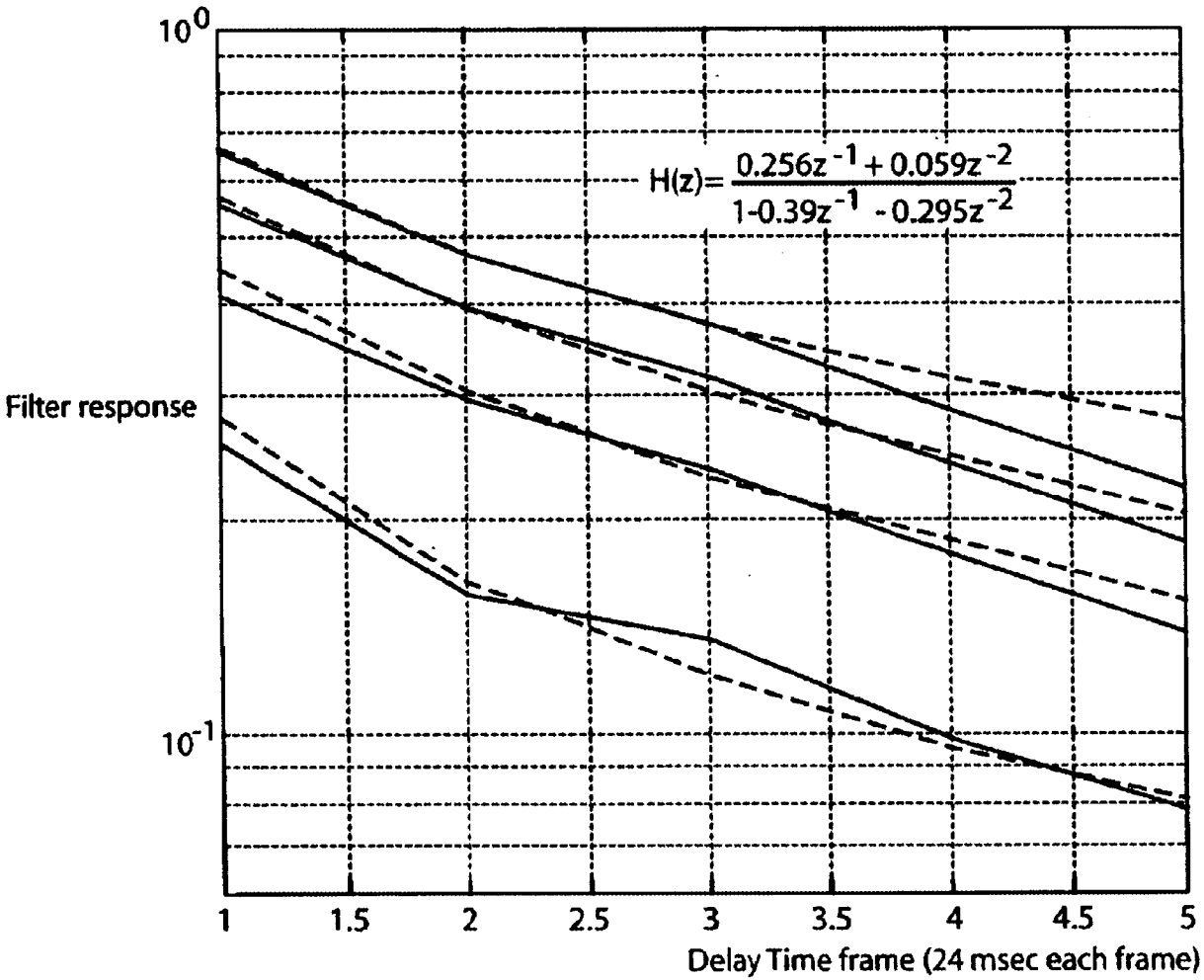
FIG. 5 is a graphical comparison of performance between an ideal filter and a 2-2 ordered ARMA IIR filter.

FIG. 5 compares the filter responses of this 2-2 filter and an ideal filter. Compared to the 3-2 ordered filter, it can be seen from this figure that there is more deviation in the 2-2 ordered filter response at the first several frames. The test result shows that there is no major degradation in performance from the 3-2 filter to the 2-2 filter.

There is one more issue in designing this temporal masking mechanism. After computing the temporal masking thresholds for different frequency bands, those results must be incorporated with the simultaneous masking thresholds. Some existing systems compare the two and pick up the maximum, while some add the two thresholds together. The preferred embodiment of the present invention shows that the encoding quality is better when the two thresholds are added to form the composite masking thresholds.

Figure 6B:
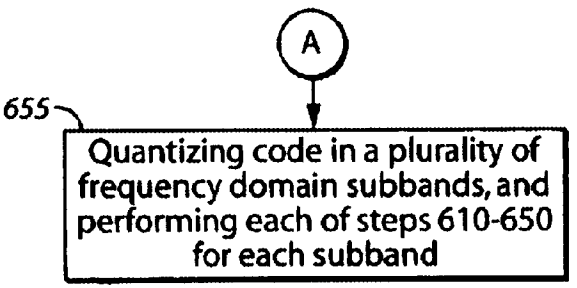
FIGS. 6A, 6B and 6C illustrate in flowchart form the method of the present invention.
Figure 6C:
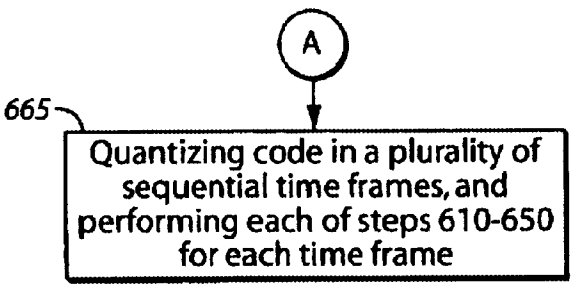
Figure 6A:
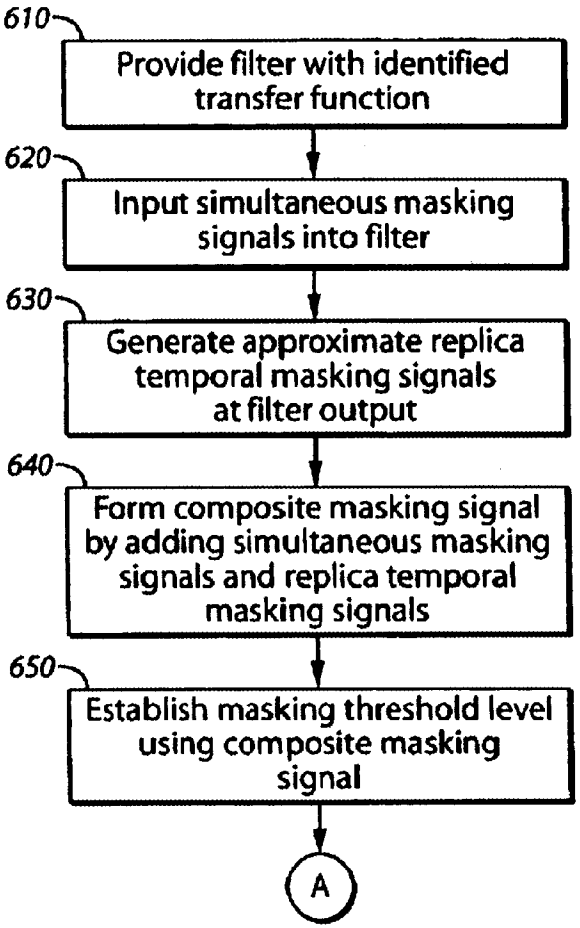

FIGS. 6A, 6B and 6C illustrate in flowchart form the above-described method of the invention. At step 610, a filter is provided, the filter having an identified transfer function. At step 620, simultaneous masking filters are input into the provided filter. At step 630, an approximate replica of appropriate temporal masking filters is generated at the filter output. A composite masking signal is then formed, at step 640, by adding simultaneous masking signals and replica temporal masking signals. At step 650, a masking threshold level is established using the generated composite masking signal. Next, the series of iterative steps illustrated as either step 655 or step 665 is executed. At step 655, as illustrated in FIG. 6A, the code is quantized in a plurality of frequency domain subbands, and each of steps 610–650 is performed for each subband. In the alternative, at step 665 as illustrated in FIG. 6B, the code is quantized in a plurality of sequential time frames and each of steps 610–650 is performed for each time frame.

Having thus described a preferred embodiment of the method of the present invention, it being understood that other embodiments are contemplated,

What is claimed is:

1. A method for generating a masking threshold level for reducing code quantization in a digital audio system, the threshold comprising both simultaneous masking and temporal masking effects on an audio signal to be coded; the method comprising:

a) providing a filter having a selected transfer function;

b) inputting simultaneous masking signals into the filter;

c) generating approximate replica temporal masking signals at the filter output;

d) adding the simultaneous masking signals and the replica temporal masking signals to form a composite masking signal; and e) using the composite masking signal to establish the masking threshold level.

2. The method recited in claim 1 further comprising:

f) carrying out said code quantization in each of a plurality of frequency domain subbands over a broad audio bandwidth; and g) performing steps a) through e) in each said subband.

3. The method recited in claim 2 wherein step g) is carried out in fewer than the total number of subbands in said plurality of subbands.

4. The method recited in claim 1 further comprising:

f) continuously carrying out said code quantization over a plurality of sequential time frames; and g) performing steps a) through e) over a selected number of said sequential time frames.

5. The method recited in claim 1 wherein said selected transfer function causes said temporal masking signals to decay approximately exponentially with the logarithm of time.

6. The method recited in claim 1 wherein said selected transfer function causes said temporal masking signals to decay at a rate which is approximately inversely proportional to the duration of the corresponding simultaneous masking signal.

7. The method recited in claim 1 wherein said filter is an infinite impulse response filter.

8. The method recited in claim 7 wherein said filter is an M order auto regressive and L order moving average filter.

9. The method recited in claim 8 wherein said filter is selected to have M=2 and L=2.

10. The method recited in claim 1 wherein said selected transfer function is of the form $$H(z)\frac{Az^{-1} + Bz^{-2}}{1 - Cz^{-1} - Dz^{-2}}$$

where A 0.25, B 0.06. C 0.39 and D 0.295.

11. A method for reducing quantization coding bits in a digital audio system by employing a masking threshold level that includes the effects of both simultaneous masking and temporal masking over a plurality of time frames; the method comprising:

a) providing a filter which has a selected transfer function for simulating temporal masking decay that is exponential with the logarithm of time;

b) inputting simultaneous masking signals into the filter;

c) generating approximate replica temporal masking signals at the filter output;

d) adding the simultaneous masking signals and the replica temporal masking signals to form a composite masking signal; and e) using the composite masking signal to establish the masking threshold level.

12. The method recited in claim 11 further comprising:

f) carrying out said code quantization in each of a plurality of frequency domain subbands over a broad audio bandwidth; and g) performing steps a) through e) in each said subband.

13. The method recited in claim 12 wherein step g) is carried out in fewer than the total number of subbands in said plurality of subbands.

14. The method recited in claim 11 further comprising:

f) continuously carrying out said code quantization over a plurality of sequential time frames; and g) performing steps a) through e) over a selected number of said sequential time frames.

15. The method recited in claim 11 wherein said selected transfer function causes said temporal masking signals to decay at a rate which is approximately inversely proportional to the duration of the corresponding simultaneous masking signal.

16. The method recited in claim 11 wherein said filter is an infinite impulse response filter.

17. The method recited in claim 16 wherein said filter is an M order auto regressive and L order moving average filter.

18. The method recited in claim 17 wherein said filter is selected to have M=2 and L=2.

19. The method recited in claim 11 wherein said selected transfer function is of the form $$H(z)\frac{Az^{-1}+Bz^{-2}}{1-Cz^{-1}-Dz^{-2}}$$

where A 0.25, B 0.06. C 0.39 and D 0.295.

* * * * *